United States Patent [19]

Priefert

[11] Patent Number: 4,930,450

[45] Date of Patent: Jun. 5, 1990

[54] LIVESTOCK HANDLING DEVICE

[75] Inventor: William D. Priefert, Mt. Pleasant, Tex.

[73] Assignee: Priefert Mfg. Co., Inc., Mt. Pleasant, Tex.

[21] Appl. No.: 304,465

[22] Filed: Feb. 1, 1989

[51] Int. Cl.[5] ..... A61D 3/00

[52] U.S. Cl. ..... 119/103

[58] Field of Search ..... 119/98, 99, 103

[56] References Cited

U.S. PATENT DOCUMENTS

| | | | |
|---|---|---|---|
| 2,458,582 | 1/1949 | Flohr, Jr. | 119/103 |
| 2,477,213 | 7/1949 | Staggs | 119/103 |
| 2,478,888 | 8/1949 | Thompson et al. | 119/103 |
| 2,674,980 | 4/1954 | Bentley | 119/103 |
| 2,688,949 | 9/1954 | Butts | 119/103 |
| 3,084,669 | 4/1963 | May | 119/99 |
| 3,099,249 | 7/1963 | Newhouse, Jr. | 119/99 |
| 3,788,280 | 1/1974 | Gilst | 119/99 |
| 3,960,113 | 6/1976 | Kratky | 119/99 |
| 4,048,961 | 9/1977 | Priefert | 119/99 |

*Primary Examiner*—Paul J. Hirsch

*Attorney, Agent, or Firm*—Rudolph L. Lowell

[57] ABSTRACT

An animal handling device including a ground supported base frame and a squeeze chute pivotally supported on the base frame by an upright lever assembly. The squeeze chute includes two side members, a flat first side member and a second, generally open second side member, that are pivotally connected at their lower end portions to permit movement of the second side member relative to the first side member into and out of an animal restraining position. By means including the upright lever assembly, the squeeze chute is pivotally movable with the lever assembly toward the first side member relative to the base frame between an upright animal receiving position and an animal shift position and then independently of the lever assembly to a substantially horizontal operational position wherein easy access to the animal for treatment procedure can be made through the second side member. In the animal shift position, the weight of the restrained animal is applied on the first side member to assist the pivotal movement of the squeeze chute to the operational position. A plurality of longitudinally spaced bars upright on the second side member are selectively movable or removed to further facilitate access to a restrained animal.

11 Claims, 4 Drawing Sheets

LIVESTOCK HANDLING DEVICE

BACKGROUND OF THE INVENTION

The invention relates generally to the handling of livestock and, more particularly, to a livestock handling device including an animal restraining squeeze chute which is pivotable between a vertical animal entry and exit position and a horizontal operational position.

There is a need for livestock handling devices to facilitate the various health procedures and other treatments common in current animal husbandry practices. With respect to cattle, in particular, the animals may be dehorned, branded, castrated, vaccinated, and otherwise treated. The variety of procedures demanded require access to the animals from a number of different attitudes or positions.

The majority of existing animal handling devices consist of squeeze chutes which immobilize the animal in a vertical or standing position only. Access to the lower parts or extremities of the animal is difficult and inconvenient and may interfere with the effective treatment procedure being administered. Accordingly, a number of known animal handling devices have been manufactured which provide a variety of means for tilting the immobilized animal to other than a vertical position. For example, U.S. Pat. No. 4,567,854 provides a squeeze chute which is mounted inside a rotatable carriage. An animal immobilized inside the squeeze chute may be rotated by the carriage as much as 180 degrees or more from its standing position.

A tiltable stock handling apparatus is described in U.S. Pat. No. 2,477,213 in which a squeeze chute is pivotable about a single horizontal axis. An animal restrained inside the squeeze chute can thereby be tilted from a standing position to a substantially horizontal position by pivotable movement of the squeeze chute about the single horizontal axis.

The present invention also provides an animal squeeze chute that is pivotable between an animal receiving or standing position and a relatively horizontal, operational position. In contrast to the prior devices, however, the present invention has a pair of horizontal pivot axes which significantly decrease the effort required to shift the animal and squeeze chute and pivot the same to the horizontal position. Tilting of the squeeze chute is easily and efficiently accomplished by a single operator, and may be a simple continuation of the closing operation of the squeeze chute. As a result of the pair of horizontal pivot axes, the weight of the immobilized animal assists in the pivotable movement of the squeeze chute from the over-center shift position to the horizontal position.

SUMMARY OF THE INVENTION

An animal handling device in accordance with the present invention includes a ground supported base frame which mounts a pivotable squeeze chute having a flat first side member and an opposing second side member consisting of a generally open barred frame. The lower ends of the two side members are pivotally interconnected to permit movement of the second side member relative to the first side member into and out of an animal restraining position. Supporting the chute on the base frame is an interconnecting upright lever assembly which is pivotally connected at its upper end to the flat side member intermediate its upper and lower ends. The lower end portion of the interconnecting upright lever assembly is pivotally connected to the base frame. Coacting abutment members are provided on the lever assembly and the base frame to initially provide an animal shift position when the lever assembly is moved from a vertical animal receiving position. Further pivotal movement of the lever assembly will pivot the squeeze chute from the shift position to a substantially horizontal operational position which is defined by coacting abutment members on the lever assembly and base frame and on the lever assembly and flat side member.

Access to an animal constrained in the squeeze chute and pivoted to the horizontal operational position is achieved through the generally open second side member. Each one of a plurality of adjustable bars of the second side member can be tilted about one end thereof or a bar may be completely removed to improve access to the animal at desired locations. Upon completion of the treatment or operational procedures, the squeeze chute is easily tiltable from its horizontal position back to the shift and animal entry and exit positions.

DETAILED DESCRIPTION OF A PREFERRED EMBODIMENT

Figure 1:
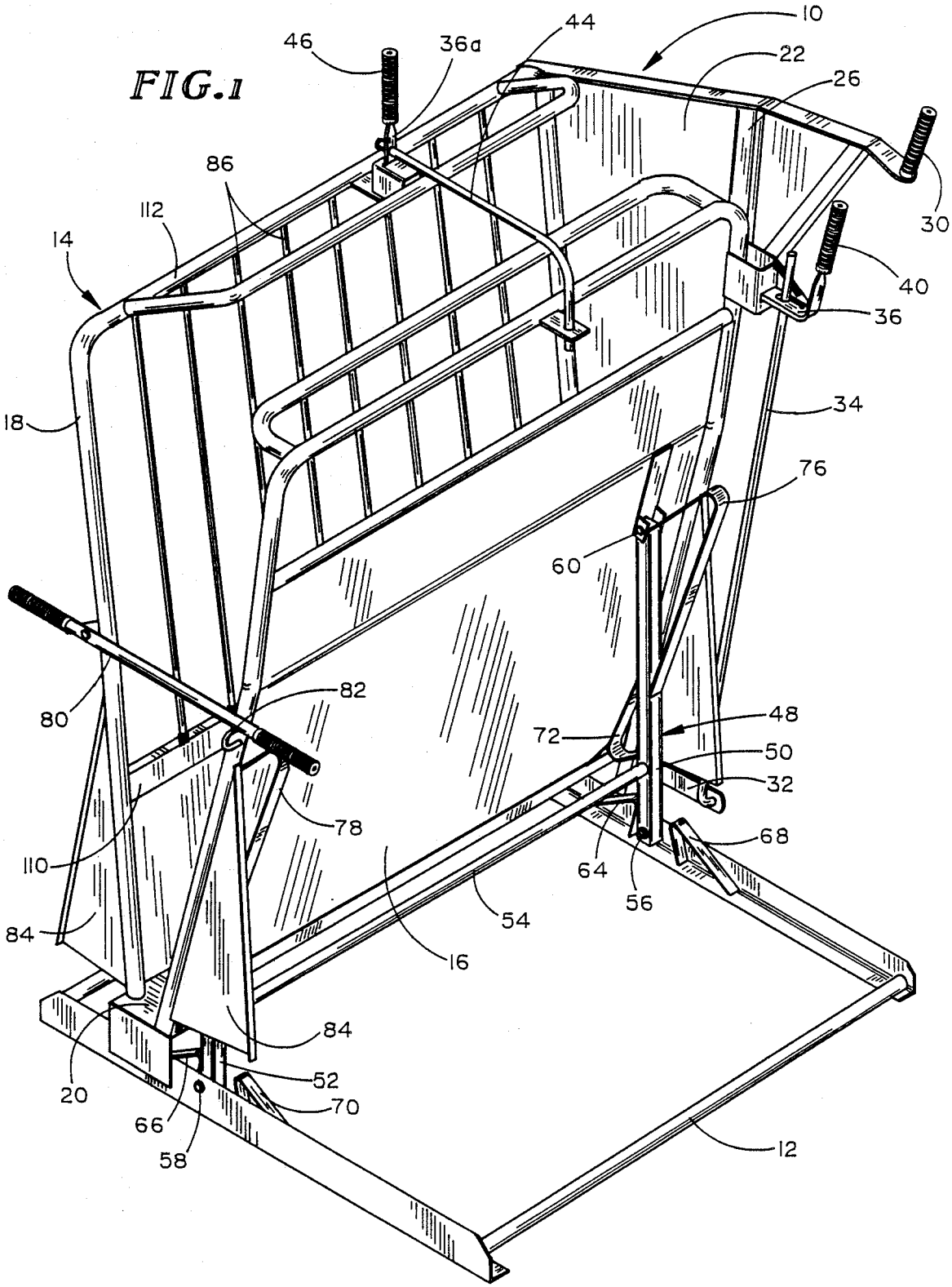
FIG. 1 is a rear perspective view of an animal handling device constructed in accordance with the present invention and shown in its upright position.

An animal handling device, indicated generally at 10 in FIG. 1, includes a generally rectangular base frame 12 which supports for relative pivotal movement thereon a squeeze chute 14 having a flat side member 16 and a second, opposing, and substantially open side member 18. The flat side member 16 is fixed to a narrow floor member 20 which extends longitudinally across the length of the animal handling device 10. The open side member 18 is mounted at its lower end portion to the floor member 20 for pivotal movement as a unit relative to the flat side member 16 between an open animal receiving position and a closed animal restraining position.

Mounted on the floor member 20 for pivotal movement relative to the flat side member 16 is a squeeze gate 22 of a generally triangular shape as best shown in FIGS. 3–6, inclusive. Pivotal movement of the squeeze gate 22 relative to the floor member 20 results in movement of the squeeze gate 22 toward and away from the flat side member 16 to closed and open positions, respectively, of the squeeze chute 14. A squeeze gate handle 30 provides means for grasping the squeeze gate to facilitate manual pivotal movement thereof.

The gate 22 (FIG. 1) is releasably locked in its closed position by means including a horizontally extended arm member 32 that extends laterally from the lower end of a neck engaging bar 26 of the squeeze gate 22. The free end portion of the arm member 32 pivotally supports a rod 34 which extends upwardly adjacent the flat side member 16 for frictional locking engagement with a pivoted lock arm 36 at the upper portion of the flat side member 16. Relative pivotal movement of the squeeze gate 22 and the flat side member 16 acts to move the upper portion of locking rod 34 within and relative to the pivotal lock arm 36. The arm 36 is spring biased and frictionally coacts with the locking rod 34 to permit movement thereof in one direction and to frictionally lock the rod 34 against movement in an opposite direction. A handle 40 is provided for actuating the arm 36 to release the rod 34. In this known manner, the squeeze gate 22 may be fixed in any moved position thereof relative to the flat side member 16.

A similar lock arm **36*a* is pivotally mounted at the top of the open side member 18 for selectively fixing the position of the open side member 18 relative to the flat side member 16. The friction lock arm 36*a* serves to releasably capture an L-shaped locking rod 44 supported on the upper end of the flat side member 16 and extended over the top of the animal handling device 10 for operative association with the friction lock arm 36*a*. A handle 46 is provided on the lock arm 36*a* to release the locking rod 44 to permit pivotal movement of the open side member 18 relative to the flat side member 16**.

Figure 2:
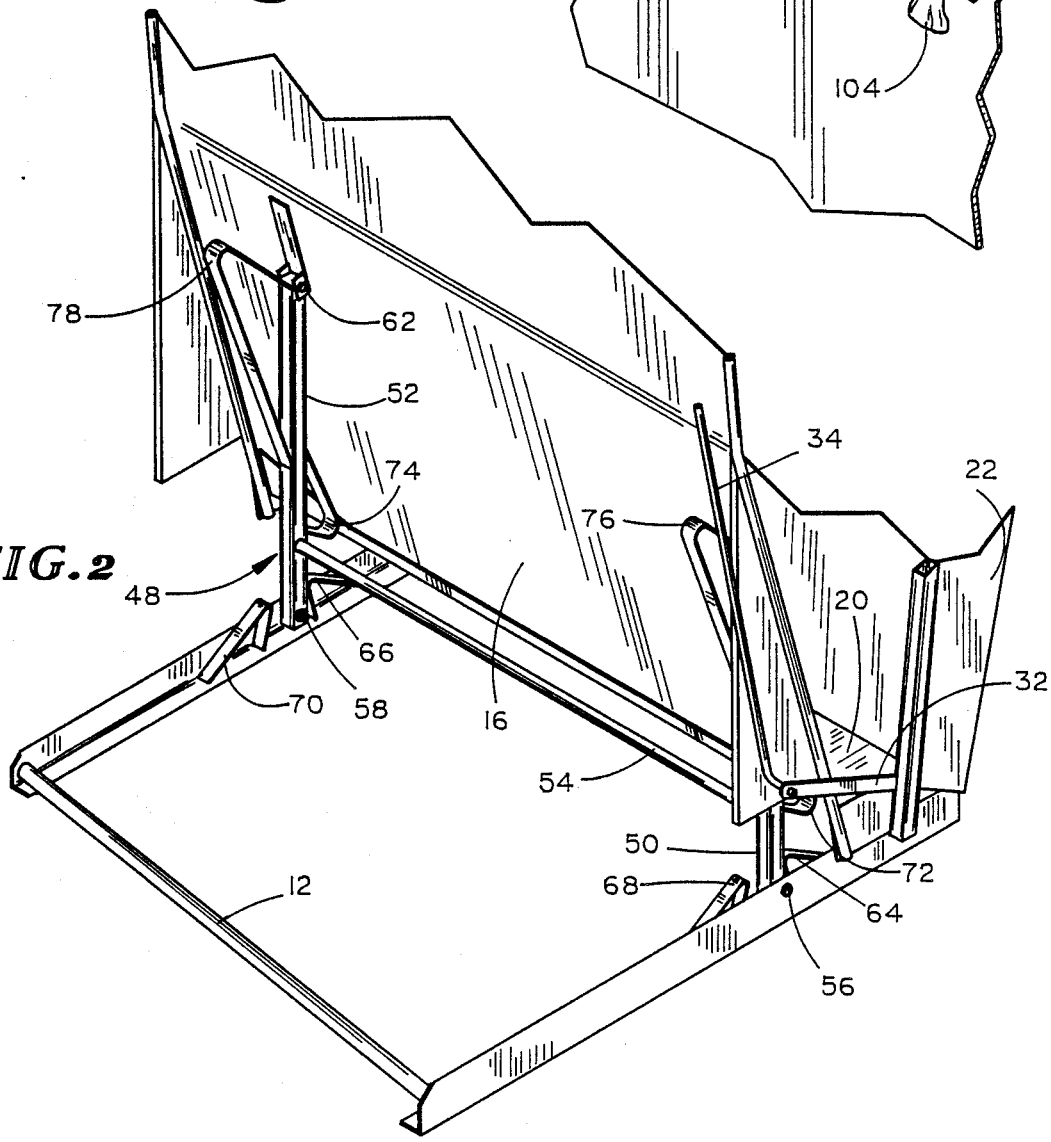
FIG. 2 is a detail perspective view of the base frame of the handling device showing the flat side of the squeeze chute and the base frame interconnected by a lever assembly for relative pivotal movement therebetween.
Figure 5:
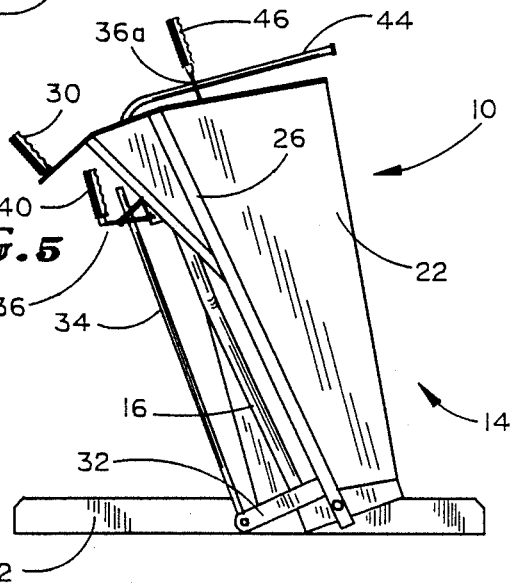
FIG. 5 is a diagrammatic end view of the exit end of the animal handling device showing the squeeze gate closed and the squeeze chute in its animal shift position.
Figure 5A:
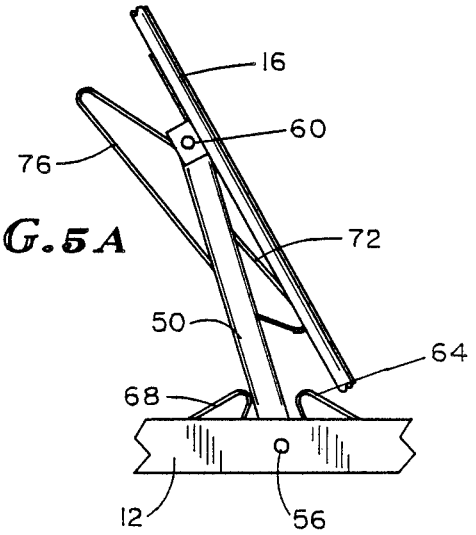
FIG. 5A is a diagrammatic view of the animal handling device illustrated in FIG. 5 showing the coacting abutment members which define the animal shift position.

The squeeze chute 14 is mounted for pivotal movement on the base frame 12 by means including an upright lever assembly, indicated generally at 48 in FIGS. 1 and 2. The lever assembly 48 consists of a pair of upright lever members 50 and 52 positioned at opposite ends of the squeeze chute 14 with the lower ends thereof pivoted at 56 and 58, respectively, on the base frame 12. A horizontal brace 54 is connected between the upright members 50 and 52. The upper end portions of the lever members 50 and 52 are pivoted at 60 and 62, respectively, (FIGS. 1 and 2) to the flat side member 16 to permit relative pivotal movement therebetween. The pivotal movement between the squeeze chute 14 and the base frame 12 is contained between selected positions by pairs of oppositely arranged coacting stop or abutment members 64 and 68, and 66 and 70, mounted on the base frame 12. A vertical or animal receiving position of the squeeze chute 14 is defined by engagement of the upright members 50 and 52 with the abutment members 64 and 66, respectively (FIG. 1). An animal shift position of the squeeze chute 14 is defined by engagement of the upright members 50 and 52 with abutment members 68 and 70, respectively (FIG. 5A).

Figure 6:
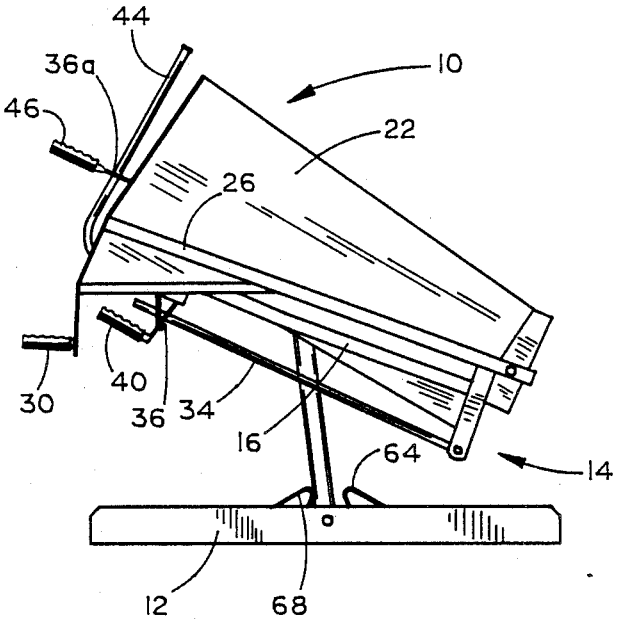
FIG. 6 is a diagrammatic end view of the exit end of the animal handling device showing the squeeze chute in its horizontal operational position.
Figure 6A:
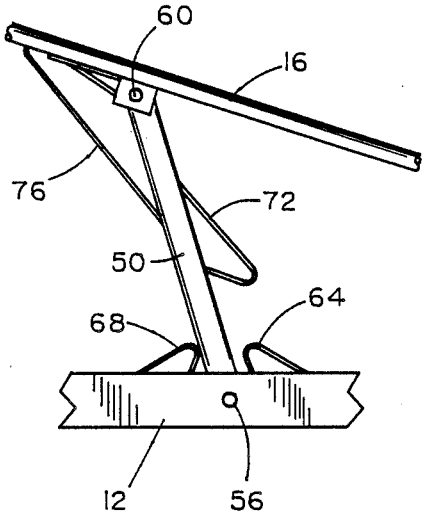
FIG. 6A is a diagrammatic view of the animal handling device illustrated in FIG. 6 showing the coacting abutment members which define the horizontal operational position of the squeeze chute.

In the animal receiving position and in the animal shift position of the chute 14, as predetermined by the corresponding positions of the upright lever assembly 48, the squeeze chute 14 is maintained in position against pivotal movement relative to the lever assembly 48 by the resting engagement of the flat side member 16 on abutment members 72 and 74 mounted on the upright levers 50 and 52, respectively, adjacent the lower ends thereof (FIG. 2). When pivoted or tilted to the animal shift position, as illustrated in FIG. 5, the squeeze chute 14 may be further pivoted or tilted relative to the upright lever assembly 48 to a horizontally inclined or operational position, as shown in FIGS. 6 and 6A. In this position, the squeeze chute 14 is held in its operational position by engagement of the flat side member 16 with the abutment members 76 and 78 that are mounted on upright members 50 and 52, respectively.

The entrance end of the animal handling device 10 opposite the squeeze gate 22 includes a guard arm 80 that is mounted for up and down pivotal movement on the open side member 18. In the position illustrated in FIG. 1, the guard arm 80 obstructs entrance of an animal into the animal handling device 10. To permit an animal to enter the squeeze chute 14, the guard arm 80 is pivoted or swung upwardly toward the open side member 18 to provide a free entrance of an animal into the chute 14. Once the animal is in the chute 14, the guard arm 80 is pivoted downwardly for extension between the chute side members 16 and 18 and into a resting engagement on a loop shaped stop 82 on the flat side 16.

Figure 3:
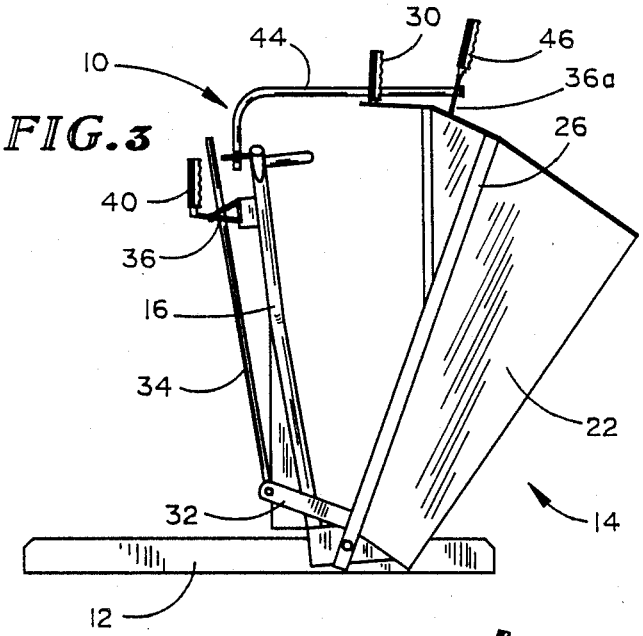
FIG. 3 is a diagrammatic end view of the exit end of the animal handling device in its upright position and showing a squeeze gate in its open position.
Figure 3A:
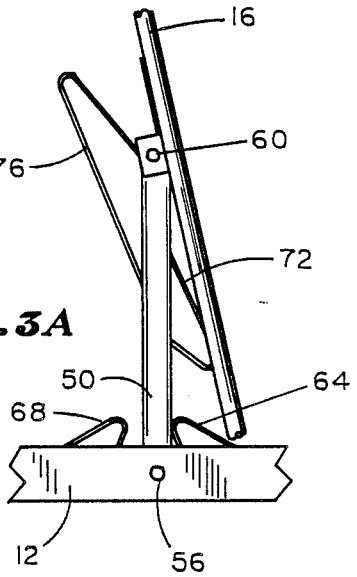
FIG. 3A is a diagrammatic view of the animal handling device illustrated in FIG. 3 showing the coacting abutment members which define the upright position of the squeeze chute.
Figure 4:
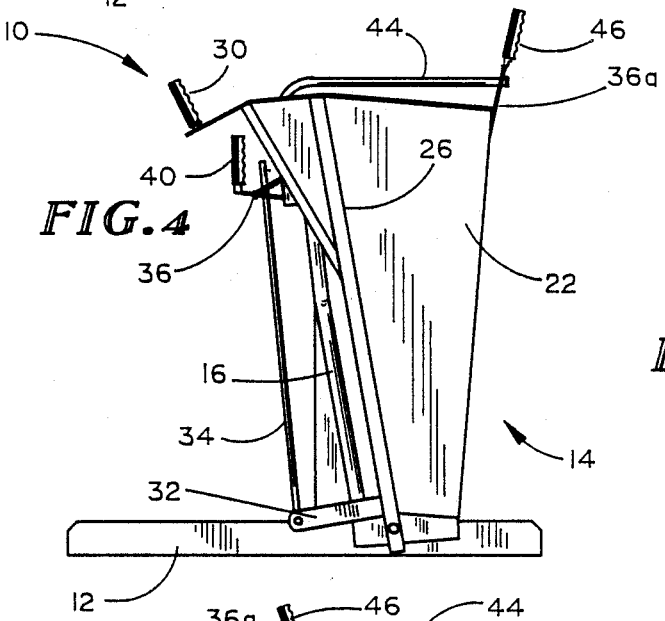
FIG. 4 is a diagrammatic end view of the exit end of the animal handling device showing the squeeze gate closed and the squeeze chute in its upright position.
Figure 4A:
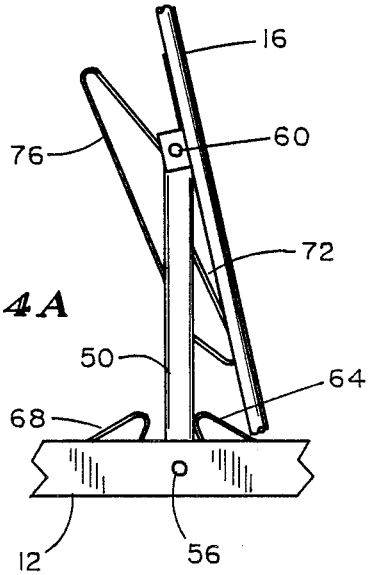
FIG. 4A is a diagrammatic view of the animal handling device illustrated in FIG. 4 showing the coacting abutment members which define the upright position of the squeeze chute.

In operation, the animal handling device is positioned with its entrance end at the open end portion of a walkway or chute (not shown) for travel of an animal from the walkway or chute directly into the animal handling device 10. A pair of laterally projected triangular shaped guards 84 on each lower end portion of the flat side member 16 and open side member 18 prevent an animal from attempting to escape around the animal handling device 10 in its travel from the walkway or chute into the squeeze chute 14. To receive an animal, the handle 46 of the lock **36*a* is moved to release the locking rod 44 to permit movement of the open side member 18 to its fully open position. As shown in FIG. 3A, when the chute 14 is to receive an animal, upright members 50 and 52 of the lever assembly 48 are in engagement with abutment members 64 and 66, respectively, and the flat side member 16 of the chute 14 is in engagement with abutment members 72 and 74. It is also important that the squeeze gate 22 be in its fully open position so that an animal on entering the animal handling device 10, and seeing daylight ahead will be less inclined to balk against entering the animal handling device 10**.

With the animal in the squeeze chute 14, the guard arm 80 is lowered by an operator to prevent the animal from backing out of the chute 14. When the head of the animal, but not the shoulders, has progressed beyond the exit end of the squeeze chute 14, the squeeze gate 22 is closed by manipulation of handle 30 so as to engage the neck of the animal between the bar 26 and the exit end portion of the flat side member 16 (FIG. 3). On closure of the squeeze gate 22 (FIG. 4), the open side member 18 is pivoted toward the flat side member 16 by actuating handle 46 to squeeze and immobilze the animal therebetween. Simultaneously with immobilizing the animal, the chute 14 is pivoted to the shift or off center position (FIG. 5). On release of the handles 30 and 46 the squeeze gate 22 remains closed and the squeeze chute 14 remains in the shift position wherein the lever members 50 and 52 are in abutting contact engagement with abutment members 68 and 70, respectively (FIG. 5A). This off-center position of the squeeze chute 14 is achieved with little effort due to the lever arm advantage provided by the pivoting of the upright lever assembly 48 at 56 and 58 on the base frame 12 and the application of the pivoting or tilting force to the upper portions of the squeeze chute 14.

Continued tilting force applied to the squeeze chute 14 will result in the chute 14 being pivoted relative to the upright lever assembly 48 about the pivots 60 and 62 from the shift position of FIG. 5 to the horizontally inclined or operational position in FIGS. 6 and 6A. During this pivotal movement, the chute flat side 16 is moved out of engagement with the abutment members 72 and 74 (FIG. 2) and into engagement with the abutment members 76 and 78. By virtue of the tilt of the chute 14 in the direction of the flat side 16 thereof, when in the shift position, the weight of the animal squeezed in the chute acts to assist in the tilting of the squeeze chute 14 from the animal shift position to the horizontally inclined operational position.

Figure 7:
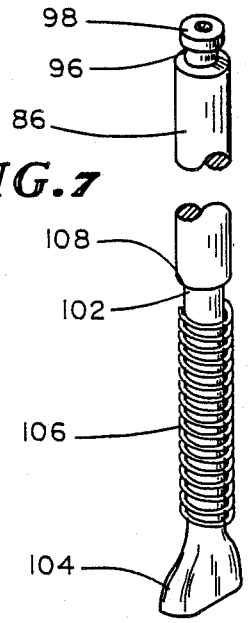
FIG. 7 is an enlarged-foreshortened perspective view showing one of the removable bars of the open side member of the squeeze chute.
Figure 8:
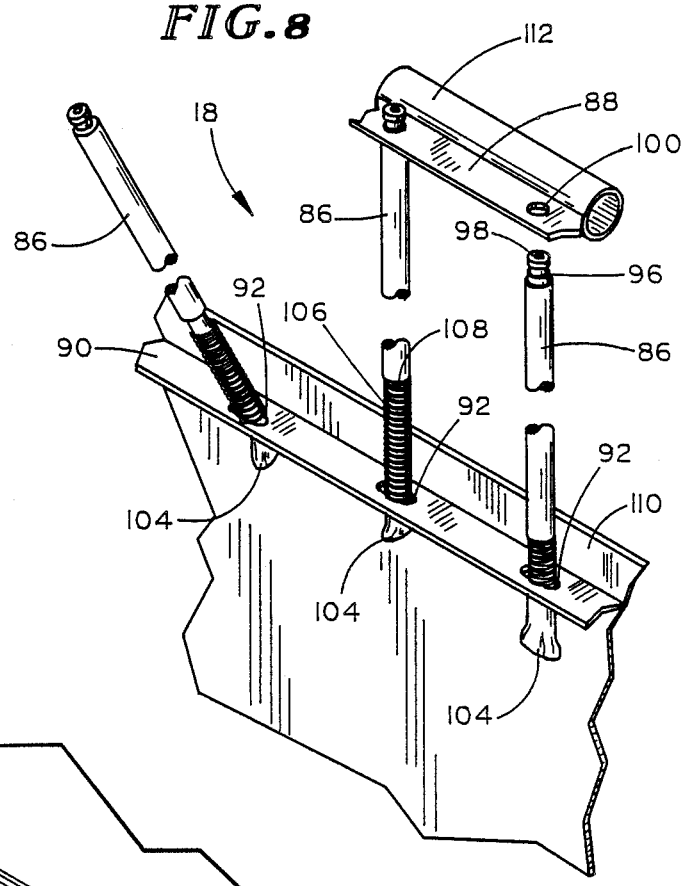
FIG. 8 is an enlarged detail perspective view showing removable bars that form a barred section in the open side member of the squeeze chute in various moved positions to facilitate access to an animal restrained within the animal handling device.

With the animal immobilized inside the squeeze chute 14, and laying against the flat side 16 in the chute operational position, access to the animal for various treatment and operational procedures can be had through the open side member 18 (FIG. 1). The open side member 18 has a barred section which includes a plurality of longitudinally spaced vertical bars 86. As illustrated in FIGS. 1 and 8, the vertical bars 86 extend between vertically spaced rail members, namely a lower rail 90 and an upper rail 88 that extend longitudinally of the open side member 18. The lower end portions of the vertical bars 86 are insertible through oval-shaped holes 92 formed in the lower rail 90. As shown in FIG. 8, the rail 88 is secured to a frame section 112, and the rail 90 is a horizontal leg of an angle iron frame member 110. The lower end portion of each vertical bar 86 is of a reduced section and terminates in an oval-shape flared member 104 of a size to pass through an associated oval-shaped hole 92 in the lower rail 90. The upper end portion 96 of each vertical bar 86 is of a reduced diameter and terminates in a disc-shaped head 98 (FIGS. 7 and 8) having a diameter less than the diameter of the body portion of the bar 86 but greater than the diameter of the reduced end portion 96. Each one of a plurality of longitudinally spaced circular holes 100 in the upper rail 88 is of a diameter to permit the passage therethrough of only the head 98 but not the body portion of a vertical bar 86.

To provide for a quick and convenient manipulation of a bar 86 for greater access to an animal, a coil spring 106 is mounted about a reduced diameter end portion 102 of each bar 86. The upper end of the spring 106 abuts against a ridge or shoulder 108 formed at the junction of the lower end portion 102 with the main body of the bar and the lower end against the lower rail 90 so that the spring 106 is compressed between the lower rail 90 and the shoulder 108 when the bar 86 is received in an oval-shaped hole 92. In this manner, the spring 106 will act to urge the vertical bar 86 upwardly wherein the upper end portion thereof 96 will be retained inside a circular hole 100 of the upper rail 88 (FIG. 8).

If it is desired to increase access to the animal inside the squeeze chute 14 (FIG. 1), any one or more of the vertical bars 86 may be either tilted relative to its lower end (FIG. 8) or removed completely from the open side 18 by first lowering of the vertical bar 86, thereby compressing the spring 106, until the upper end portion of the vertical bar 86 has been removed from its corresponding circular hole 100, as illustrated by the bar on the left in FIG. 8. Once the upper end portion of the vertical bar 86 has been removed from the corresponding circular hole 100, it either can be left in the lower rail 90 and pivoted out of the way, or it may be rotated to align the lower end portion of the vertical bar 86 with the oval-shaped hole 92 for complete removal from the lower rail 90.

The invention has been described with reference to the preferred embodiment. Modifications and alterations will occur to others upon reading and understanding the detailed description of the preferred embodiment. It is intended that the invention be construed as including all such alterations and modifications insofar as they come within the scope of the following claims.

We claim:

1. An animal handling device comprising:

(a) a ground supported base frame;

(b) an animal restraining chute having a flat first side member and a second opposite side member movable relative to said first side member into and out of an animal restraining position;

(c) an upright lever assembly pivotally mounting said chute for pivotal movement on said base frame from a substantially upright position for said first side member to a horizontally inclined animal operational position thereof to form a table for supporting an animal on its side for operational access through said second side member;

(d) said lever assembly extended between and pivotally connected to said base frame and to said first side member at a position intermediate the upper and lower ends of said first side member;

(e) coacting means on said lever assembly and base frame for limiting pivotal movement of the lever assembly in one direction relative to the base frame to an animal receiving position of the chute, and in an opposite direction to an animal shift position wherein the weight of the animal acts to assist the movement of the chute to the inclined position of the first side member;

(f) said chute, with the lever assembly in the animal shift position being pivotally moved relative to the upper end of the lever assembly to the inclined position of the first side member;

(g) means for releasably locking said second side member in an animal restraining position prior to pivotal movement of said chute to said animal shift position, and (h) coacting means on said first side member and lever assembly for defining said horizontally inclined position of the first side member.

2. The method of manipulating an animal restraining chute from an upright animal receiving position to a horizontally inclined animal operational position wherein the animal lies on one side against a flat side member of the chute for operational performance through the opposite side member of the chute, comprising the steps of:

(a) providing a ground supported base structure, (b) supporting the chute on the base structure by an interconnecting upright lever assembly, (c) pivotally connecting the upper end portion of the assembly to the flat side member between the upper and lower ends thereof, when the chute is in the upright position therefor (d) pivotally connecting the lower end portion of the assembly to the base structure, (e) maintaining the chute against pivotal movement relative to the upper end of the lever assembly while moving the chute from an animal receiving position, wherein the lever assembly is in an over-center position to one side of the pivotal connection at the lower end thereof, to an over-center position of the lever assembly to the opposite side of the pivotal connection at the lower end thereof, and then (f) moving the chute relative to the pivotal connection at the upper end of the lever assembly to the animal operational position therefor.

3. The method according to claim 2, including the steps of:

(a) pivotally connecting the upper end of the lever assembly to the flat side member a shorter distance from the lower end thereof than from the upper end thereof, and (b) pivotally connecting the lower end of the lever assembly to the base structure to one side of and below the lower end of the flat side member.

4. An animal handling device comprising:

(a) a ground supported base frame, (b) an animal restraining chute having a first side member and a second opposite side member movable relative to said first side member into and out of an animal restraining position, (c) an upright lever assembly extended between and pivotally interconnected to said one side member and base frame, (d) said lever assembly pivotally movable in one direction relative to said base frame to an animal receiving position of said chute and in an opposite direction relative to said base frame to an animal shift position wherein the weight of the restrained animal acts to assist a later pivotal movement of the chute from said shift position to a horizontally inclined animal operational position of said first side member to form a table for supporting the restrained animal on its side for operational access through the second side member, and (e) said chute, with the lever assembly in said animal shift position, being pivotally movable relative to the upper end of the lever assembly to the inclined position of the first side member.

5. The animal handling device according to claim 4 including:

(a) coacting abutment means on said first side member and lever assembly for retaining said chute for movement as a unit with said lever assembly from the animal receiving position to the animal shift position therefor.

6. The animal handling device according to claim 4 including:

(a) coacting abutment means on said lever assembly and base frame for limiting pivotal movement of said lever assembly to the animal receiving position and to the animal shift position of the chute.

7. The animal handling device according to claim 4 wherein:

(a) said chute includes a floor member secured to said first side member, and said lever assembly is located to the outside of said first side member, (b) means pivotally connecting the lower end of the lever assembly to the base frame adjacent the ground surface and below said floor member, and (c) means pivotally connecting the upper end of the lever assembly to the first side member intermediate the upper and lower ends thereof.

8. The animal holding device according to claim 4 wherein:

(a) said lever assembly is in a substantially vertical position when the chute is in the animal receiving position therefor, and in a position vertically inclined in the direction of pivotal movement of the first side member to the animal operational position therefor, when the chute is in the animal shift position therefor.

9. The animal holding device according to claim 4 wherein:

(a) said second side member includes a rod section comprised of a pair of vertically spaced rod supporting members extended longitudinally of the second side member, (b) said supporting members having longitudinally spaced vertically aligned holes therein, (c) a plurality of rod members corresponding to said vertically aligned holes, (d) with each rod member having opposite end portions receivable in a corresponding pair of vertically aligned holes; and (e) coacting means on one of the end portions of each rod member and an adjacent support member for yieldably holding a rod member in a vertically supported position extended between said support members.

10. An animal handling device, comprising:

(a) a ground supported base frame;

(b) an animal restraining chute having a first side member and a second opposite side member movable relative to said first side member into and out of an animal restraining position;

(c) a lever assembly pivotally mounted on said base frame and pivotally interconnected with said chute for pivotal movement of said chute from a substantially upright animal receiving position to a horizontally inclined position wherein said first side member forms a table to support an animal on its side for operational access through said second side member; and (d) first stop means for limiting pivotal movement of said chute in one direction to said animal receiving position, and second stop means for limiting pivotal movement in an opposite direction to said animal operational position.

11. A method of manipulating an animal restraining chute from an upright animal receiving position to a horizontally inclined animal operational position wherein the animal lies on one side against a first side member of the chute for operational performance through an opposite, second side member of the chute, comprising:

(a) providing a ground supported base structure;

(b) pivotally interconnecting the chute with said base structure by a lever assembly;

(c) pivotally moving the chute about a pivot at one end portion of said lever assembly between the upright animal receiving position and an intermediate animal shift position; and then (d) pivotally moving the chute about a pivot at the opposite end portion of said lever assembly between said intermediate animal shift position and the horizontally inclined animal operational position.

* * * * *